US008178804B2

(12) United States Patent
Park

(10) Patent No.: US 8,178,804 B2
(45) Date of Patent: May 15, 2012

(54) MOVABLE CONTACTOR FOR AIR CIRCUIT BREAKER WITH CONTACT SPRING PROTECTING MECHANISM

(75) Inventor: Woo-Jin Park, Chungcheongbuk-Do (KR)

(73) Assignee: LS Industrial Systems Co., Ltd., Anyang (KR)

( * ) Notice: Subject to any disclaimer, the term of this patent is extended or adjusted under 35 U.S.C. 154(b) by 969 days.

(21) Appl. No.: 12/146,702

(22) Filed: Jun. 26, 2008

(65) Prior Publication Data

US 2009/0014417 A1 Jan. 15, 2009

(30) Foreign Application Priority Data

Jul. 12, 2007 (KR) ..... 10-2007-0070264

(51) Int. Cl.
*H01H 5/00* (2006.01)

(52) U.S. Cl. ..... 200/304; 200/239; 200/DIG. 42; 218/89

(58) Field of Classification Search ..... 200/400
See application file for complete search history.

(56) References Cited

U.S. PATENT DOCUMENTS

| | | | |
|---|---|---|---|
| 4,716,165 | A | 12/1987 | Abou-Gharbia et al. |
| 4,716,265 | A | 12/1987 | Fujii et al. |
| 5,341,191 | A | 8/1994 | Crookston et al. |
| 5,361,052 | A | 11/1994 | Ferullo et al. |
| 5,899,323 | A | 5/1999 | Rakus |
| 2007/0268100 | A1 | 11/2007 | Schaltenbrand et al. |
| 2008/0087534 | A1 | 4/2008 | Yang et al. |
| 2008/0088395 | A1 | 4/2008 | Seo |
| 2008/0088396 | A1 | 4/2008 | Ahn et al. |
| 2008/0122563 | A1 | 5/2008 | Song |
| 2008/0157906 | A1 | 7/2008 | Oh |

FOREIGN PATENT DOCUMENTS

| | | |
|---|---|---|
| CN | 1238539 | 12/1999 |
| DE | 3729745 | 3/1988 |
| DE | 20114426 | 1/2003 |
| EP | 0543496 | 5/1993 |
| EP | 1244122 | 9/2002 |
| EP | 1858041 | 11/2007 |
| JP | 62-117229 | 5/1987 |
| JP | 63-44354 U | 3/1988 |
| JP | 8-227648 | 9/1996 |
| JP | 9-161641 | 6/1997 |
| JP | 9-288960 A | 11/1997 |
| JP | 11-329169 A | 11/1999 |
| JP | 2003-297215 | 10/2003 |
| RU | 28418 | 3/2003 |
| SU | 1767570 | 10/1992 |

OTHER PUBLICATIONS

U.S. Appl. No. 12/144,793 to Lyu, filed Jun. 24, 2008.
U.S. Appl. No. 12/147,698 to Yang, filed Jun. 27, 2008.
U.S. Appl. No. 12/163,002 to Sohn, filed Jun. 27, 2008.
U.S. Appl. No. 12/164,296 to Ahn, filed Jun. 30, 2008.
U.S. Appl. No. 12/164,691 to Ahn, filed Jun. 30, 2008.
U.S. Appl. No. 12/165,789 to Kim et al., filed Jul. 1, 2008.

(Continued)

*Primary Examiner* — Renee Luebke
*Assistant Examiner* — Lheiren Mae Caroc
(74) *Attorney, Agent, or Firm* — Greenblum & Bernstein, P.L.C.

(57) ABSTRACT

A movable contactor for an air circuit breaker with a contact spring protecting mechanism is provided, the movable contactor comprising a shielding plate configured to shield exposed surfaces of the contact springs for protection so as to prevent a deterioration or performance degradation in the contact springs due to arcs.

3 Claims, 7 Drawing Sheets

OTHER PUBLICATIONS

English language Abstract of JP 8-227648, Sep. 3, 1996.
English language Abstract of JP 9-161641, Jun. 20, 1997.
English language Abstract of EP 1244122, Sep. 25, 2002.
English language Abstract of DE 20114426, Jan. 2, 2003.
Japan Office action, mail date is Feb. 8, 2011.

MOVABLE CONTACTOR FOR AIR CIRCUIT BREAKER WITH CONTACT SPRING PROTECTING MECHANISM

RELATED APPLICATION

The present disclosure relates to subject matter contained in priority Korean Application No. 10-2007-0070264, filed on Jul. 12, 2007, which is herein expressly incorporated by reference in its entirety.

BACKGROUND OF THE INVENTION

1. Field of the Invention

The present invention relates to a movable contactor for an air circuit breaker, and particularly, to a movable contactor for an air circuit breaker with a contact spring protecting mechanism which is capable of minimizing damage to contact springs due to arcs occurred upon a tripping operation.

2. Background of the Invention

An air circuit breaker refers to an electric apparatus which can manually or automatically block a relatively low voltage circuit among power receiving and distributing apparatuses, thus to diverge the low voltage circuit and protect circuits and equipment. The air circuit breaker includes contactor portions provided with a stationary contactor connected to a circuit of a power source or a electric load, and a movable contactor movable to a position to come in contact with or be separated from the stationary contactor to open or close the circuit. The movable contactor is separately provided for each AC (Alternating Current) phase of R, S, T and N. The movable contactor for each phase includes a plurality of movable conductors (so-called movable arms) so as to divide flowing current for management. Also, each of the plurality of movable conductors is provided with a contact spring which is installed at a rear side thereof to push its corresponding movable conductor toward the stationary contactor so as to keep the stationary contactor coming in contact with the movable conductor in its closed state (i.e., a conducted state, so-called on-state).

Configuration and operation of an exemplary movable contactor according to the related art will be described with reference to FIGS. 1 and 2.

First, the configuration and operation of the movable contactor for the related art air circuit breaker is described with reference to FIG. 1 which is a perspective view of the movable contactor obliquely shown from its upper side in order to illustrate the configuration of the movable contactor for the related art air circuit breaker.

The movable contactor for the related art air circuit breaker shown in FIG. 2 shows a movable contactor of a particular phase among movable contactors provided for each AC phase of R, S, T and N, for example. As shown in FIG. 2, the movable contactor 1 of the particular phase is provided with a plurality of movable conductors 10 for dividing flowing current for management.

Each of the plural movable conductors 10 includes a main contact 2 and an arc contact 3 on its front surface. Upon a closing operation (i.e., upon a switch-on operation), the arc contact 3 of the movable conductor 10 comes in contact with an arc contact of the stationary contactor and thereafter the main contact 2 of the movable conductor 10 comes in contact with a main contact of the stationary contactor, such that the main contact 2 and the arc contact 3 of the movable conductor 10 can contact those of the stationary contactor. The arc contacts are separated from each other after the main contacts come in contact with each other.

Each of the plural movable conductors 10 is provided with a contact spring 8 installed at its rear side to supply an elastic force by which the corresponding movable conductor 10 is pushed toward the stationary contactor such that the stationary contactor can stably come in contact with the movable conductor 10 of the movable contactor 1 upon the closing operation.

An unexplained reference numeral 4 in FIG. 2 designates a pivot shaft portion protruding from a lower side of the movable contactor 1, 5 designates a pivot shaft support for pivotably supporting the pivot shaft portion 4 so as not to be shaken, 6 designates a bus bar for connecting a conducting line to the movable contactor 1, and 7 designates a cage configuring an outer case of the movable contactor 1.

In the meantime, FIG. 1 is a side view of the movable contactor for the related art air circuit breaker, particularly, showing an introduction of arcs into a contact spring. Upon a closing operation, arcs of high temperature and high voltage are introduced between the contact of the movable contactor 1 and the contact of the stationary contactor, for example, along an arc introduction path A of FIG. 1.

Especially, the movable contactor for the related art air circuit breaker has a structure in which upper surfaces of the contact springs 8 are open as shown in FIG. 2. Accordingly, the contact springs are damaged due to an exposure to arcs introduced along the arc introduction path A, which results in a degradation in an elastic force of the contact springs due to impurities adhered thereon. The damage to the contact springs and the degradation in the elastic force thereof cause a decrease in a conducting performance of the air circuit breaker in its on state.

Furthermore, the performance degradation in part of the contact springs causes a current concentration on movable conductors supported by the remaining contact springs. As a result, the contact adhered on the movable conductor cannot cope with large current so as to be melted, which may cause the opening operation not to be performed when a circuit is needed to be broken.

In addition, decrease in the lifespan of the air circuit breaker and increase in a maintenance cost therefore may be caused.

SUMMARY OF THE INVENTION

Therefore, an object of the present invention is to provide a movable contactor for an air circuit breaker with a contact spring protecting mechanism capable of protecting contact springs from arcs of high temperature and high voltage and minimizing an introduction of impurities.

To achieve these and other advantages and in accordance with the purpose of the present invention, as embodied and broadly described herein, there is provided a movable contactor for an air circuit breaker, in a movable contactor for an air circuit breaker with contact springs, the movable contactor comprising: a shielding plate configured to shield (cover) exposed surfaces of the contact springs for protection, thereby preventing a deterioration or performance degradation in the contact springs due to arcs.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

The object of the present invention and configuration, operations and effects of the present invention to achieve the object will be more clearly understood by the following detailed description of the preferred embodiments of the present invention, with reference to the accompanying drawings.

Figure 1:
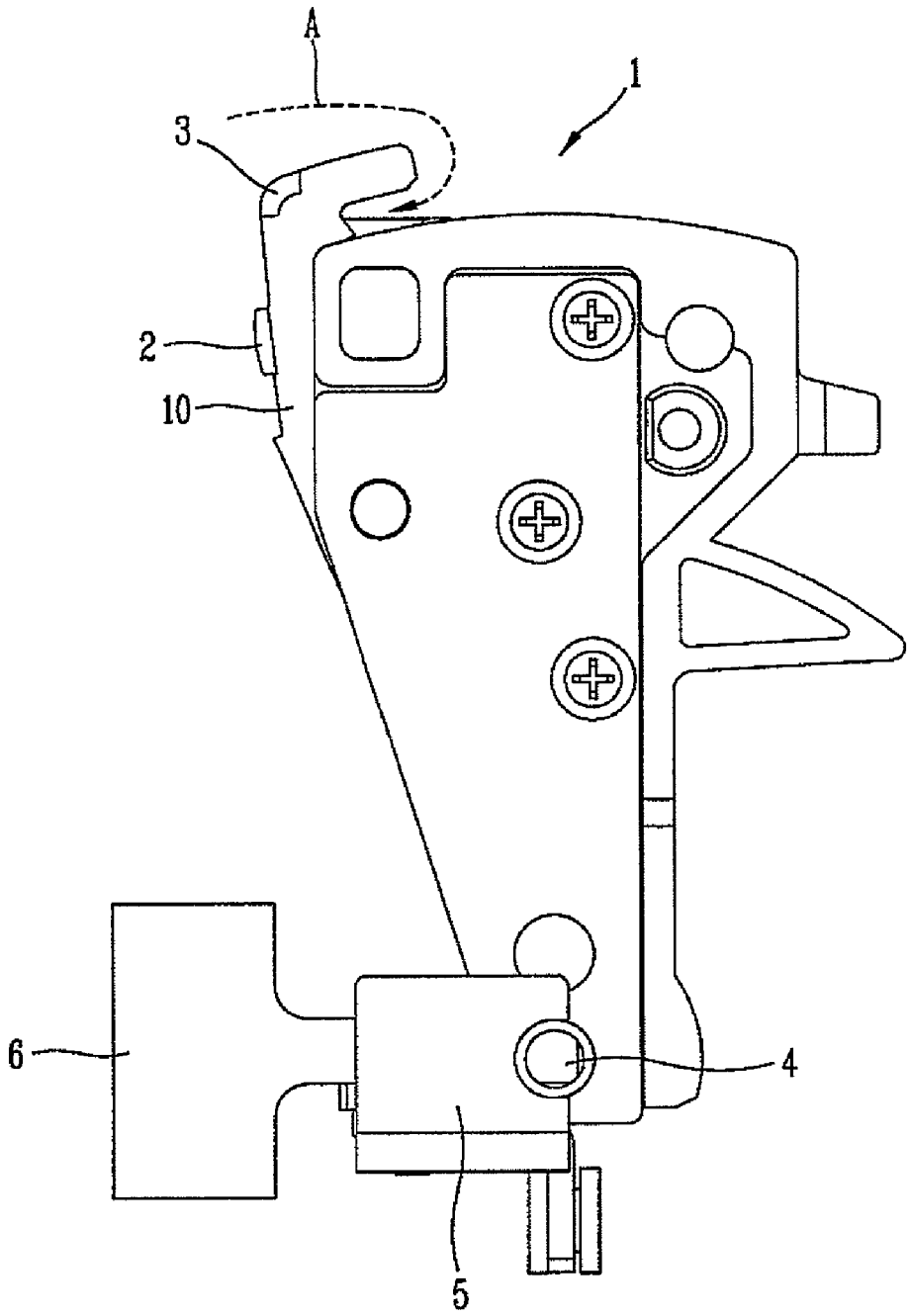
FIG. 1 is a side view of a movable contact for an air circuit breaker according to the related art, which shows an introduction of arcs into contact springs.
Figure 2:
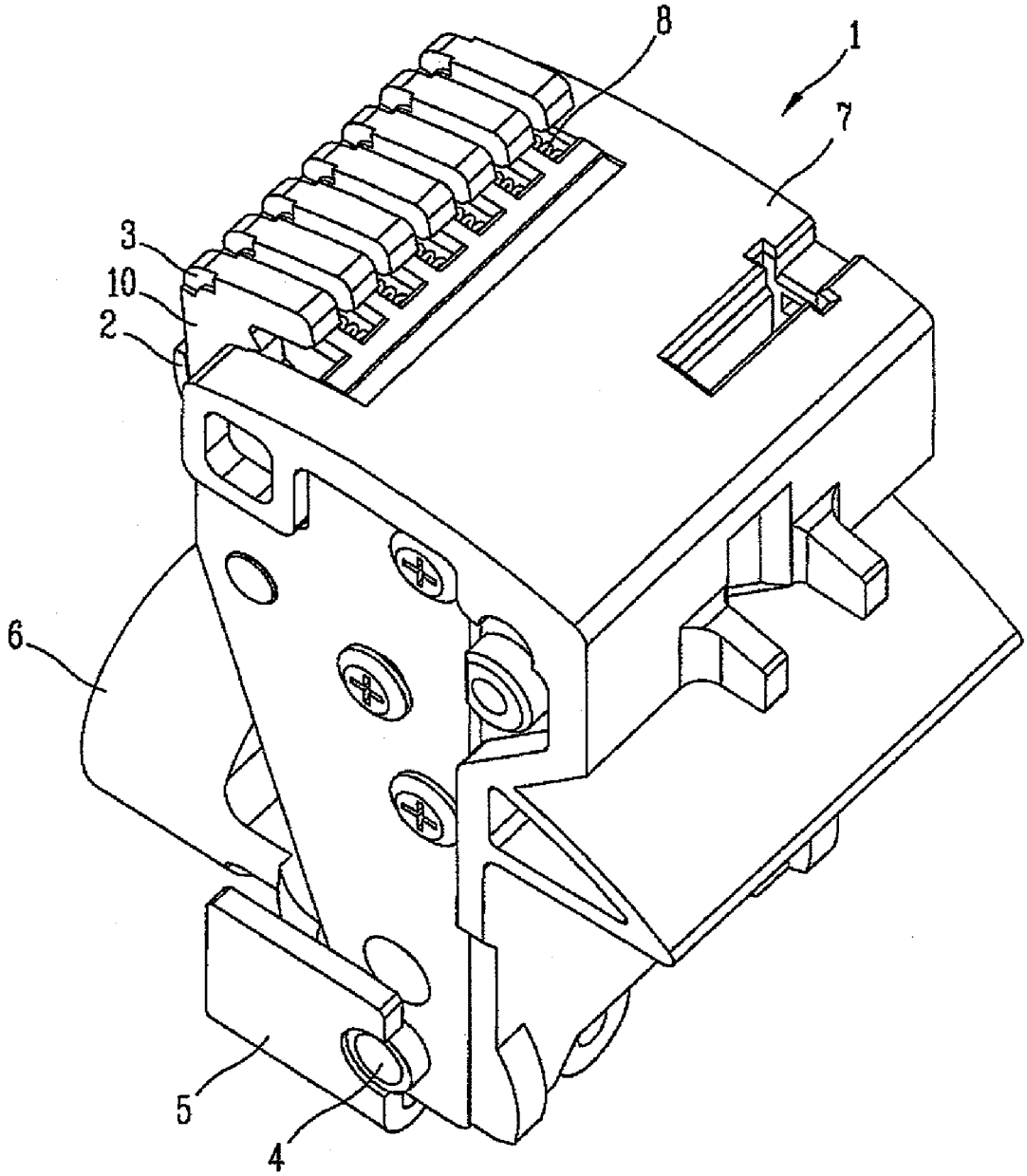
FIG. 2 is a perspective view of the movable contactor obliquely shown from its upper side in order to illustrate the configuration of the movable contactor for the related art air circuit breaker.
Figure 3:
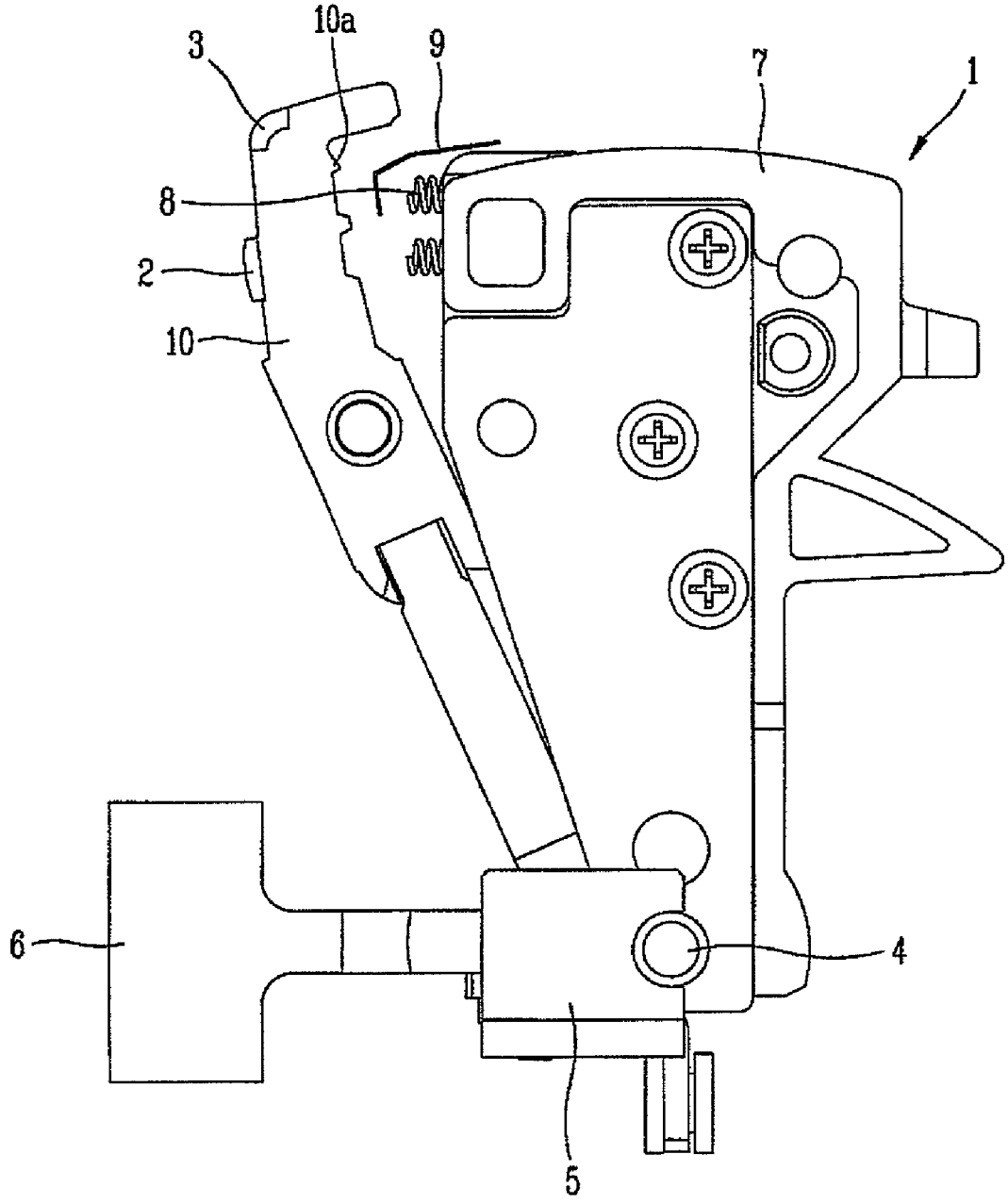
FIG. 3 is a view showing an assembly process of installing a shielding plate in a movable contactor for an air circuit breaker according to the present invention, namely, a side view of the movable contactor in which a movable conductor is opened up such that a front surface of a contact spring is exposed.
Figure 4:
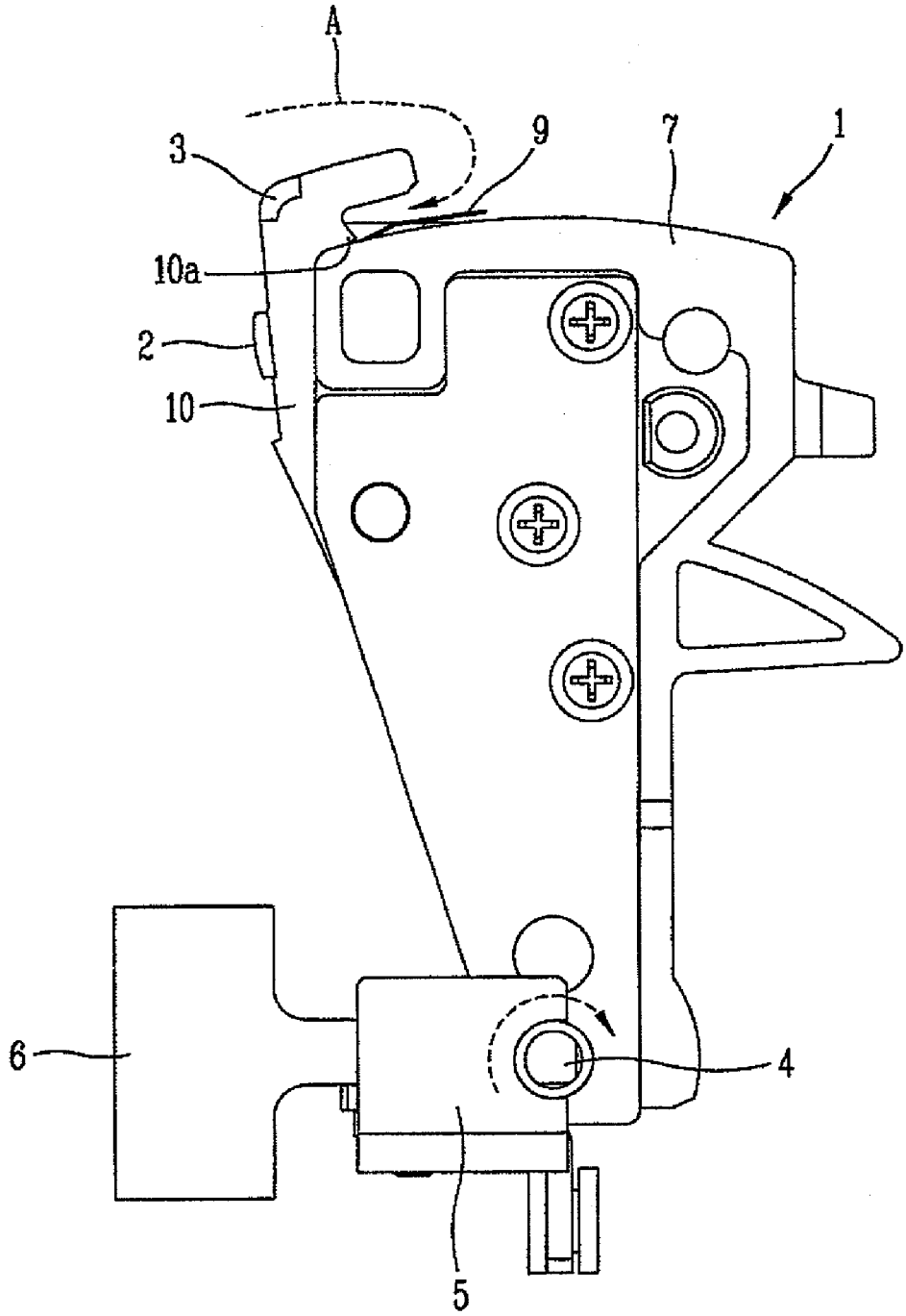
FIG. 4 is a view showing the assembly process of installing the shielding plate in the movable contactor for the air circuit breaker according to the present invention, namely, a side view of the movable contactor in which the shielding plate is partially inserted between the movable conductor and the contact spring so as to be completely installed.
Figure 5:
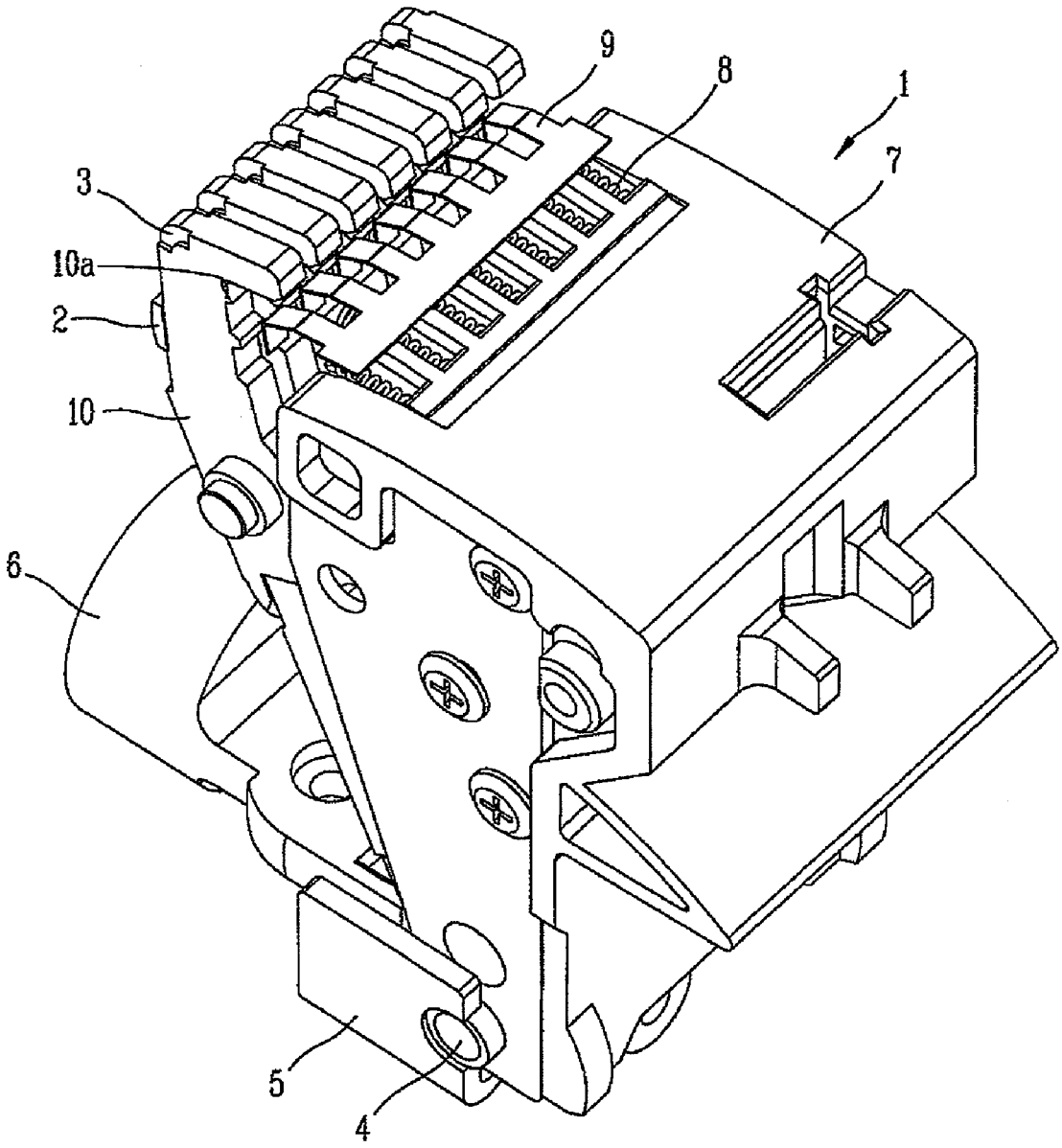
FIG. 5 is a view showing the assembly process of installing the shielding plate in the movable contactor for the air circuit breaker according to the present invention, namely, a perspective view of the movable contactor in which the movable conductors are opened such that the front surfaces of the contact springs are exposed.
Figure 6:
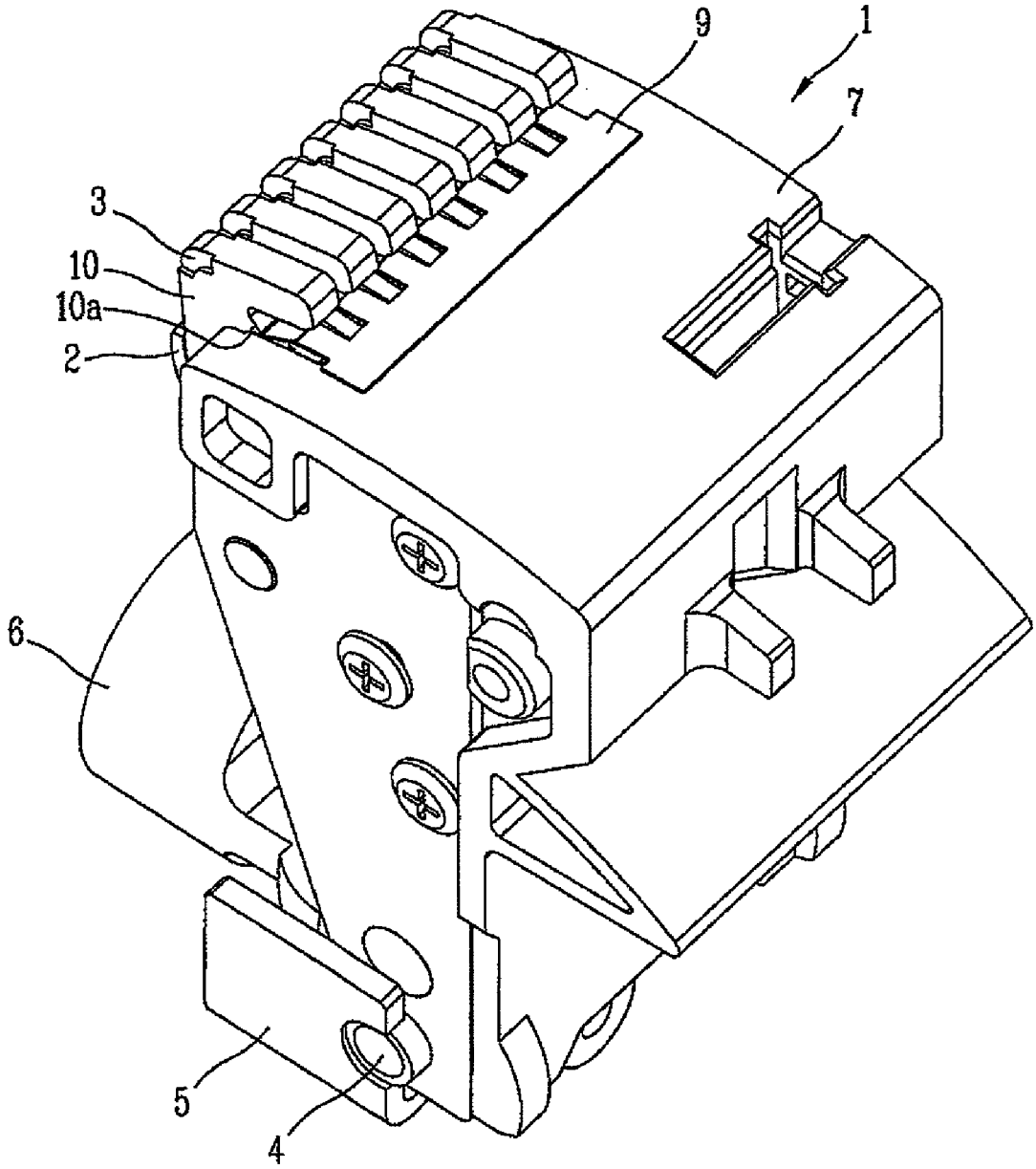
FIG. 6 is a view showing the assembly process of installing the shielding plate in the movable contactor for the air circuit breaker according to the present invention, namely, a perspective view of the movable contactor in which the shielding plate is partially inserted between the movable conductors and the contact springs so as to be completely installed.

Similar to the related art movable contactor, a movable contactor 1 for an air circuit breaker (hereinafter, referred to as 'movable contactor') according to the present invention, as shown in FIGS. 3 to 6, refers to a movable contactor of any one phase among movable contactors disposed for each AC phase of R, S, T and N. As shown in FIGS. 5 and 6, a movable contactor 1 of any one phase is provided with a plurality of movable conductors 10 which divide flowing currents for management.

Also, similar to the related art, each of the plural movable conductors 10 is provided with a main contact 2 and an arc contact 3 disposed at an upper portion of its front surface. Upon a closing operation (i.e., upon a switch-on operation), the arc contact 3 of the movable conductor 10 comes in contact with an arc contact of the stationary contactor and thereafter the main contact 2 of the movable conductor 10 comes in contact with a main contact of the stationary contactor, such that the main contact 2 and the arc contact 3 of the movable conductor 10 can contact those of the stationary contactor. The arc contacts are separated from each other after the main contacts come in contact with each other.

Each of the plural movable conductors 10 is provided with a contact spring 8 installed at its rear side to supply an elastic force by which the corresponding movable conductor 10 is pushed toward the stationary contactor such that the contact of the stationary contactor can stably come in contact with the main contact 2 of the movable conductor 10 of the movable contactor 1 upon the closing operation.

An unexplained reference numeral 4 in FIGS. 3 to 6 designates a pivot shaft portion protruding from a lower side of the movable contactor 1, 5 designates a pivot shaft support for pivotably supporting the pivot shaft portion 4 so as not to be shaken, 6 designates a bus bar for connecting a conducting line to the movable contactor 1, and 7 designates a cage configuring an outer case of the movable contactor 1.

As a characteristic configuration, the movable contactor 1 for the air circuit breaker according to the present invention may include a shielding plate 9 configured to shield exposed surfaces of the contact springs 8 for protection, thereby preventing a deterioration or performance degradation in the contact springs 8 due to arcs.

The movable conductor 10 has a structure of being opened up in a rotation manner to make the contact springs 8 exposed. That is, after a support shaft for the movable conductors 10 supported at the cage 7 based on the support shaft is disassembled, when the movable conductors 10 are rotated in a counterclockwise direction in FIG. 5, the upper portions of the movable conductors 10 are spaced apart from the cage 7, so as to expose the contact springs 8.

Hereinafter, the installation process for the shielding plate 9 is described with reference to FIGS. 3 to 6.

Figure 7:
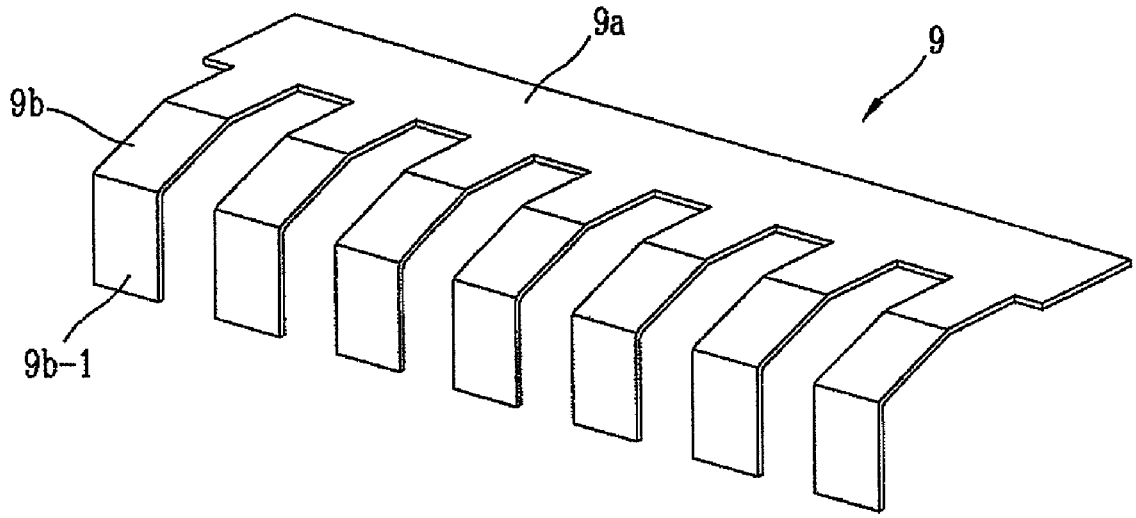
FIG. 7 is a perspective view of a detailed configuration of the shielding plate in the movable contactor for the air circuit breaker according to the present invention.

As shown in FIGS. 3 and 5, the movable conductor 10 is rotated to expose the contact springs 8 such that the upper portions of the movable conductors 10 are spaced apart from the cage 7. Afterwards, a part of the shielding plate 9 (particularly, curved portions **9*b*-1 for shielding the front surfaces of the contact springs 8, respectively, as shown in FIG. 7) is inserted between the movable conductors 10 of the movable contactor 1 and the contact springs 8**.

Then, the movable conductors 10 are rotated in a clockwise direction in FIGS. 3 and 5 and their support shaft is coupled to the cage 7, thus to be in the state as shown in FIGS. 4 and 6, thereby completing the installation of the shielding plate 9.

As can be clearly seen in FIG. 3, the movable conductor 10 has spring seats (reference numeral not given) disposed up and down at the upper portion of its rear surface and implemented as concavo-convex portions for supporting the contact springs 8 so as not to be missed. In particular, the convex portion at the portion corresponding to an upper spring seat forms a support protrusion **10*a* sharply protruding so as to press and thus support the shielding plate 9** in order to prevent the separation of the shielding plate.

The shielding plate 9, on the other hand, is referred to as, for example, an insulating paper, and made of an electric insulating material which is easily buyable. The shielding plate 9 is formed as an elastic thin plate to have an elastic force. As shown in FIG. 7, the shielding plate 9 may include a plurality of shielding pieces **9*b* for shielding the exposed surfaces of the plural contact springs 8, and a common connection portion 9*a* for allowing one end portions of the plural shielding plate pieces 9*b*** to be integrally connected all together.

Also, each of the plural shielding plate pieces **9*b* of the shielding plate 9 has a curved portion 9*b*-1 to shield the front surfaces of the contact springs 8**.

Therefore, as the movable contactor 1 for the air circuit breaker can install the shielding plate 9 mounted as aforementioned to protect the contact springs 8 from arcs and impurities introduced into the contact springs 8, the shielding plate 9 can protect the contact springs 8 from damage due to arcs and minimize an adhesion of impurities onto the contact springs 8. Also, the installation of the shielding plate 9 can provide an operational effect without interfering with the operation of the movable contactor 1 for closing or opening (switching) a circuit. In the movable contactor 1 for the air circuit breaker according to the present invention, the contact spring protecting mechanism can be employed so as to protect the contact springs 8 from arcs and minimize an introduction of impurities into the contact springs 8, which results in an improvement of operational reliability of the air circuit breaker, thereby elongating the lifespan of the air circuit breaker.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A movable contactor for an air circuit breaker, in a movable contactor for an air circuit breaker with a plurality of contact springs, the movable contactor comprising:

a shielding plate configured to shield exposed surfaces of the contact springs for protection so as to prevent a deterioration or performance degradation in the contact springs due to arcs, the shielding plate comprising:

a plurality of shielding pieces made of an elastic insulating material and formed as an elastic thin plate to have an elastic force, so as to shield the exposed surfaces of the plurality of contact springs from arcs; and a common connection portion configured to allow one end portions of the plurality of shielding pieces to be integrally connected all together, wherein each of the plurality of pieces has a curved portion so as to shield the front surface of each contact spring, the front surface facing towards a main contact of the movable contactor; and movable conductors rotatable so as to expose the contact springs, wherein the shielding plate is partially inserted between the movable conductors and the contact springs for installation.

2. The movable contactor of claim 1, wherein the shielding plate is made of an insulating paper.

3. The movable contactor of claim 1, wherein each of the movable conductors is provided with a support protrusion for pressing and thus supporting the part of the shielding plate so as to prevent the separation of the shielding plate.

* * * * *